United States Patent [19]

Waters

[11] Patent Number: 4,893,356

[45] Date of Patent: Jan. 16, 1990

[54] AIR CONDITIONED HEADWEAR HAVING CONVERTIBLE POWER MODULE

[76] Inventor: William A. Waters, 3648 East 49th St., Tulsa, Okla. 74135-3102

[21] Appl. No.: 99,791

[22] Filed: Sep. 22, 1987

[51] Int. Cl.[4] ..... A42C 5/04

[52] U.S. Cl. ..... 2/171.3; 2/199; 2/422

[58] Field of Search ..... 2/171.3, 199, 422, 436, 2/437, 8, 10, 6, 185 R

[56] References Cited

U.S. PATENT DOCUMENTS

| | | | |
|---|---|---|---|
| 3,353,191 | 11/1967 | Dahly | 2/171.3 |
| 3,735,423 | 5/1973 | Droz | 2/171.3 |
| 3,881,198 | 5/1975 | Waters | 2/171.3 |
| 3,906,548 | 9/1975 | Kallis | 2/416 X |
| 4,238,857 | 12/1980 | Waters | 2/171.3 |
| 4,672,968 | 6/1987 | Lenox et al. | 2/171.3 X |
| 4,680,815 | 7/1987 | Hirsch et al. | 2/171.3 |

OTHER PUBLICATIONS

Gershman, "Self Adhering Nylon Tapes", 10-18-58, J.A.M.A. vol. 68, No. 7, p. 930.

*Primary Examiner*—Peter A. Nerbun
*Attorney, Agent, or Firm*—Head & Johnson

[57] ABSTRACT

Headwear, including all forms of caps, hats, hard hats, visor type caps, to include a switchable power module capable of converting an electric motor driven air moving means from battery power to solar power wherein the solar power panel is removable.

48 Claims, 9 Drawing Sheets

AIR CONDITIONED HEADWEAR HAVING CONVERTIBLE POWER MODULE

SUMMARY OF THE INVENTION

The invention herein is particularly applicable to all types of headwear including hats, helmets (inclusive of pith, safari or "jungle" helmet types), industrial helmets and hardhats such as welder's protective headwear, safety caps, miner's caps (sometimes called "hardhats" or "bump caps"), various kinds of visors and general wear caps which are complete or partial head coverings. The invention is applicable to all types of headwear constructed of a variety of materials such as cloth, plastic, metal, straw, stiffened and treated paper, etc.

A specific object of the invention is to simply, quickly and easily provide such headwear, as above described, with some form of electric motor driven air moving and cooling means which will cause the moving air to be cooled by an evaporative moistened pad which air will then pass against, across or around the head of the wearer, while providing also a quick and easy means of converting the power from battery to solar or vice-versa.

A further object of the invention is to provide electric motor driven air moving and cooling means for all types of headwear which will permit simple, quick and easy removal of a solar power unit from the headwear for replacement of defective solar power panels and/or to protect the solar panel from damage when the headwear is worn in certain environments, and at the same time retain battery power for the electric motor.

In particular, the invention is to provide a power module that permits the convertibility of power to an electric motor driven air moving and cooling means on headwear from solar to battery power and vice versa. The module can be rigidly attached to the headwear or formed as a part of an apparatus which is easily attached or detached to the headwear. Particularly, concerning the detachable apparatus, the power module is attached to a plastic strap or frame which is then removably attached to the headwear. The strap or frame would support the power module for receiving the solar panel, the battery power, and the electric motor driven air moving means, all as an integral unit. The power module has means to detachably receive the solar panel. The module includes a switch along with appropriate electric wiring means to innerconnect the power, either solar or battery, and the electric driven motor air moving means or fan.

In those instances where the electric motor driven air moving means is removably attached, and the power module is permanently affixed to the headwear, the batteries are firmly attached, usually out of sight, inside the headwear along with the wiring which is an integral part of the module to electrically connect through a receptacle the solar power panel. This connection may be a typical plug and socket (or jack) type. Thus, electrical connection is made through the switch to transmit the power from either the battery or the solar panel to the electric motor which drives the air moving means. Usually the module is located atop the headwear. The solar panel, with its electrical plug, is removably attached to the power module. Specifically, the invention herein described is directed to headwear that has means to circulate cooled air upon, across or around the head of the wearer. The headwear usually has at least one opening therein with an electric motor driven air moving means, i.e. blower or fan, positioned contiguously of the opening with a moistened pad interposed between opening and head of the wearer. A first power means e.g., battery, is attached to the headwear and connected to the electric motor. A power module is attached to the headwear and has incorporated as a part thereof means, such as a plug and socket arrangement, to removably receive an alternate power source e.g., solar panel. The power module also includes a switch to selectively connect or disconnect the first power means or the alternate power source with the electric motor.

An additional embodiment of the invention is an apparatus for attachment to headwear that comprises a strap means in which the strap means has means to releasably attach the strap to the headwear. The strap means contains an electric motor driven air moving means (fan) situated thereon which when attached to the headwear will move or draw air through a moistened pad upon or around the head of the wearer. A first power source, e.g. battery, means is attached to the strap means which power source means is selectively and electrically connectable to the electric motor. Another embodiment of this latter invention is the inclusion of a power module that is attached to the strap wherein the module has means to removably receive a solar cell or a panel of solar cells. The module has means to selectively connect and disconnect a battery power means or the solar cell or panel with the electric motor.

DETAILED DESCRIPTION OF THE DRAWINGS

Before explaining the present invention in detail, it is to be understood that the invention is not limited to its application to the details of construction and arrangement of parts illustrated in the accompanying drawings, since the invention is capable of other embodiments and of being practiced or carried out in various ways commensorate with the claims herein. Also it is to be understood that the phraseology or terminology employed herein is for the purpose of description and not of limitation.

Figure 1:
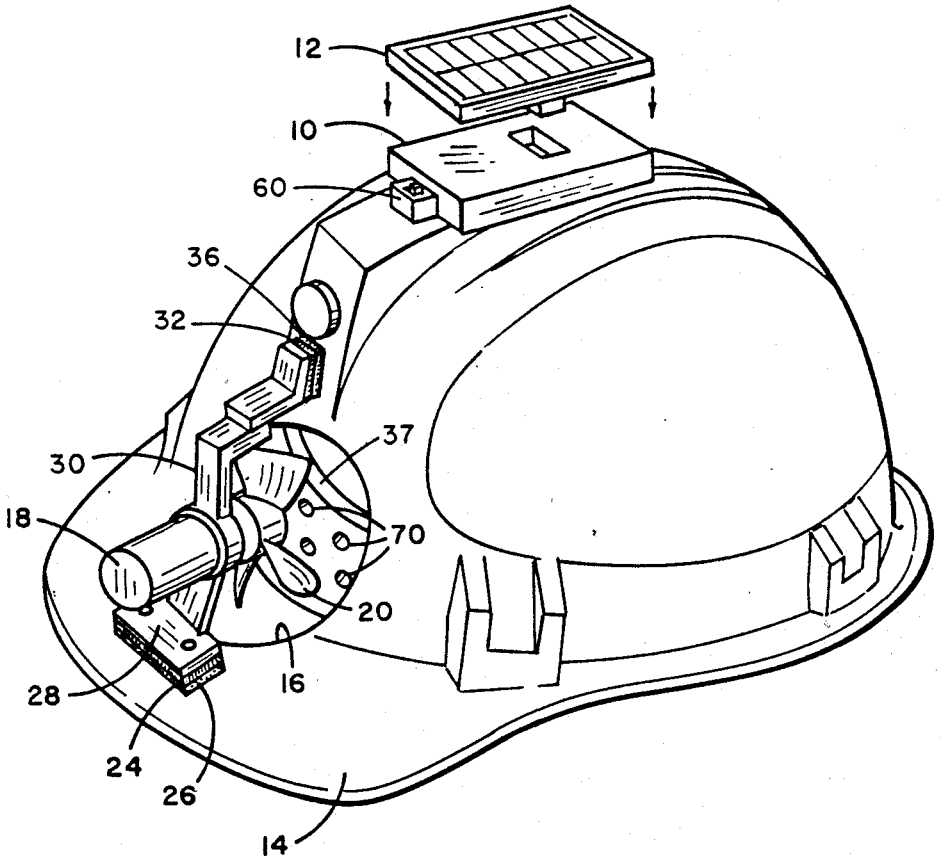
FIG. 1 is a perspective view of a hardhat modified to receive the electric motor driven air moving means of this invention.
Figure 2:
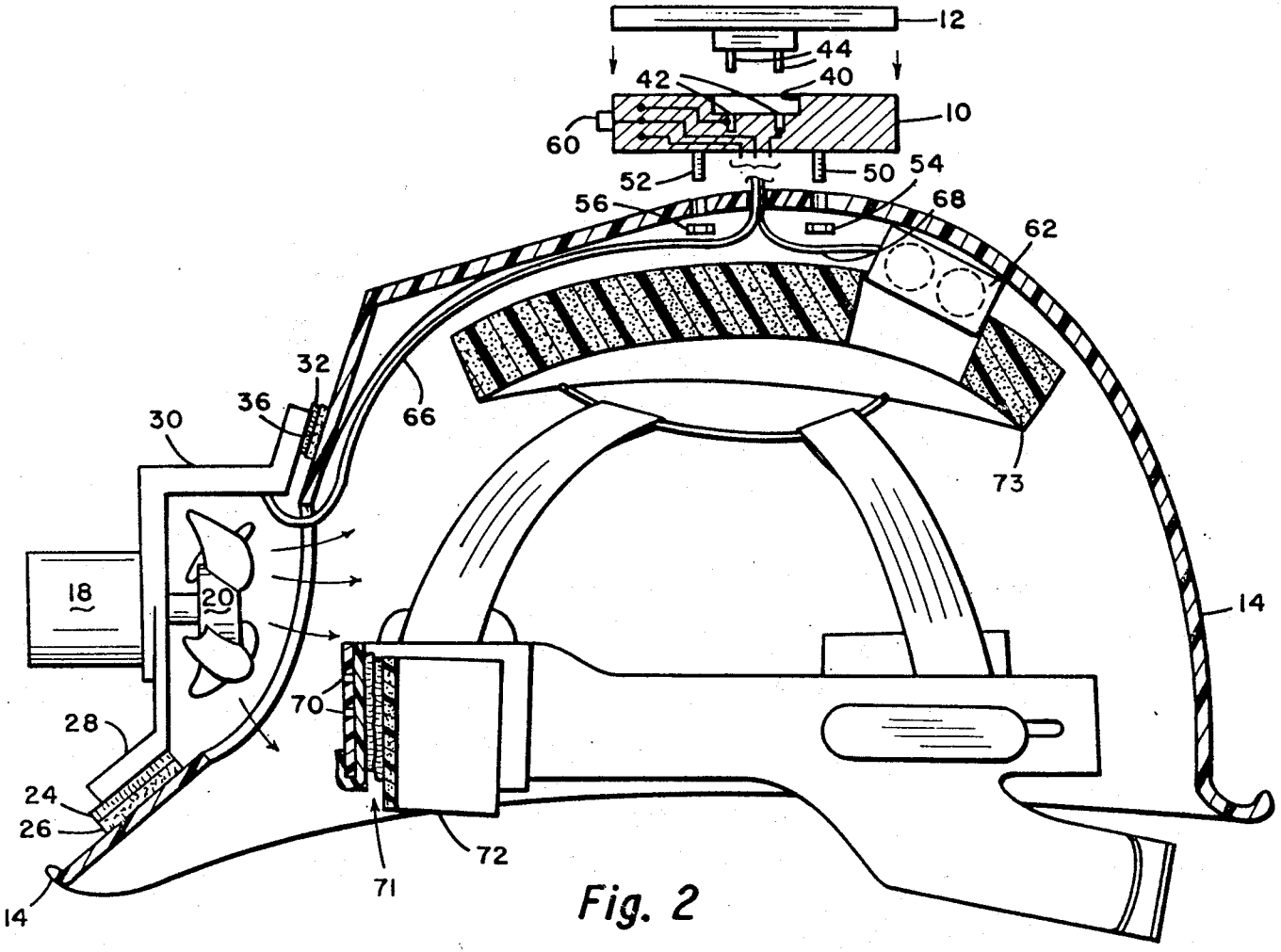
FIG. 2 is a sectional, partly exploded, view of the hard hat of FIG. 1.

Referring first to FIGS. 1 and 2 of the invention, the power module 10 is shown attached to a hardhat to which is adapted to receive a plug-in type solar panel 12 as herein more specifically described, the module 10 being attached to a hardhat 14 of a standard and well known type. The hardhat is modified to include an opening 16 for an electric motor 18 which is attached to a fan 20 which is positioned adjacent the opening to provide air movement through the opening and into the space surrounding the head of the wearer. The electric motor and its driven fan 20 is, in this embodiment, shown as being removable as a unit from the hardhat by "Velcro" fasteners 24 and 26 which absorb vibration and are formed as a part of a lower electric motor-fan support 28. An upper support 30 is similarly fastened to the hardhat by "Velcro" fasteners 32 and 36. A headband 37 has, in one embodiment openings 70.

Referring more particularly to FIG. 2, the apparatus of the invention describes the power module 10 as having a receptacle space 40 with electrical sockets 42 which are adapted to receive electrical plugs 44 of a solar panel 12. The solar panel 12 comprises at least one solar cell and preferably a plurality of innerconnected solar cells. The power module also includes threaded means 50 and 52 with nuts 54 and 56 representing but one means to attach the power module 10 to the hardhat 14. The power module also includes an easily accessible switch 60 for innerconnecting the wiring as best described in FIG. 12 for alternately connecting the battery power pack 62 (located inside the hardhat 14) and the electric motor 18 and its driven fan 20, the wiring 66 and 68 generally being hidden inside the hardhat. An embodiment of the invention, for all headwear, includes a modification of the headband, to have a plurality of openings 70, to which is removably attached, as by "Velcro" 71, a foam pad 72 which, when moistened, either intentionally or by sweat, provides an evaporative cooling effect on the head of the wearer. A similar pad 73 inside the crown may also be used as an evaporative cooling effect. The term "hardhat" as used herein is meant to include not only the specific designs shown, but also include other types of safety hats, including welder's hats, miner's hats, etc.

Figure 3:
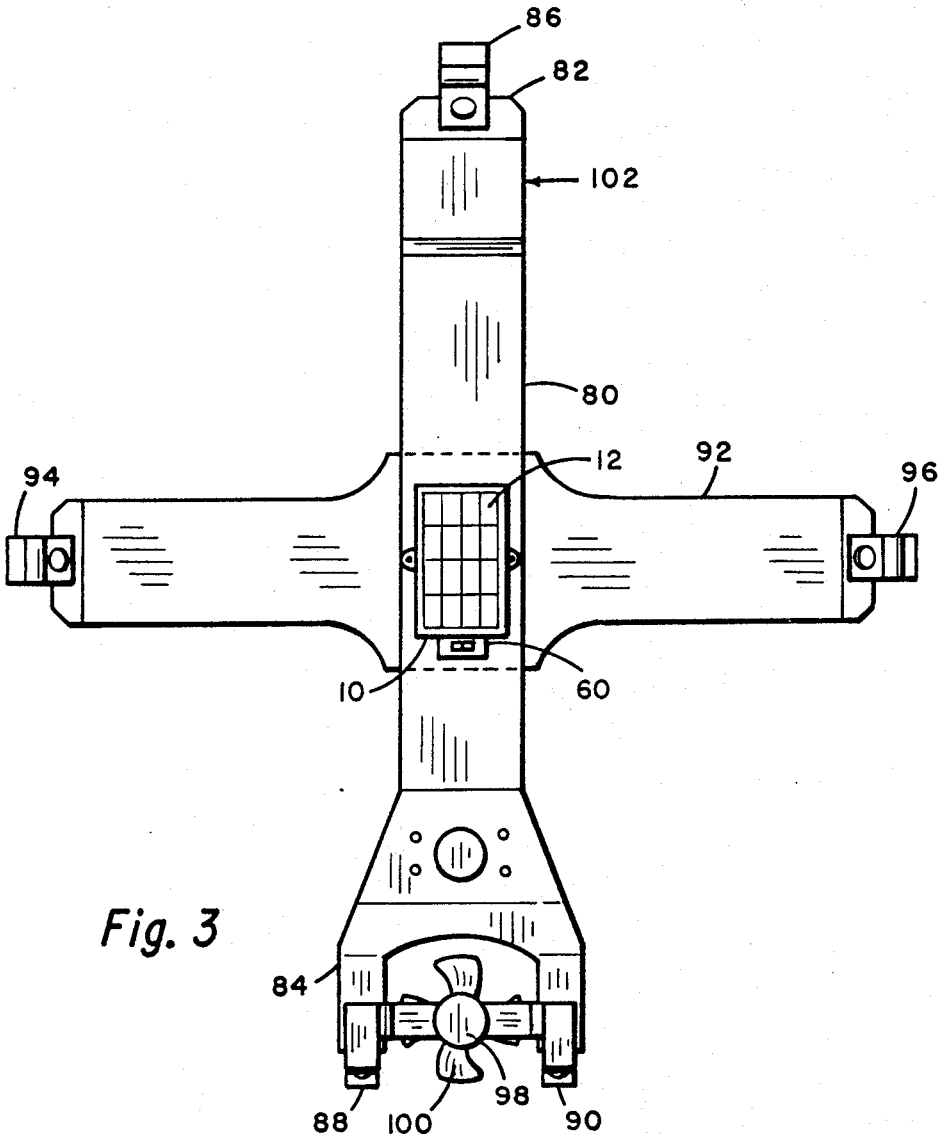
FIG. 3 is a top elevation view of a strap containing motor driven air moving means and its power sources for attachment to headwear.
Figure 9:
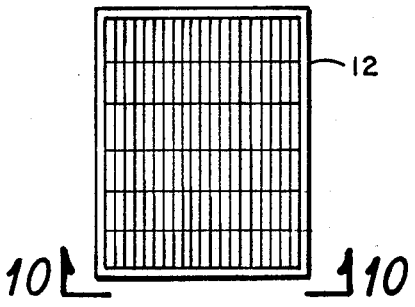
FIG. 9 is a top view of a typical solar panel for use with the invention.
Figure 10:
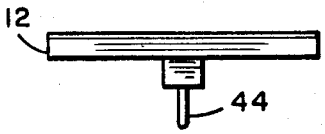
FIG. 10 is a side view of the solar panel of the invention taken along the line 10—10 of FIG. 9.
Figure 4:
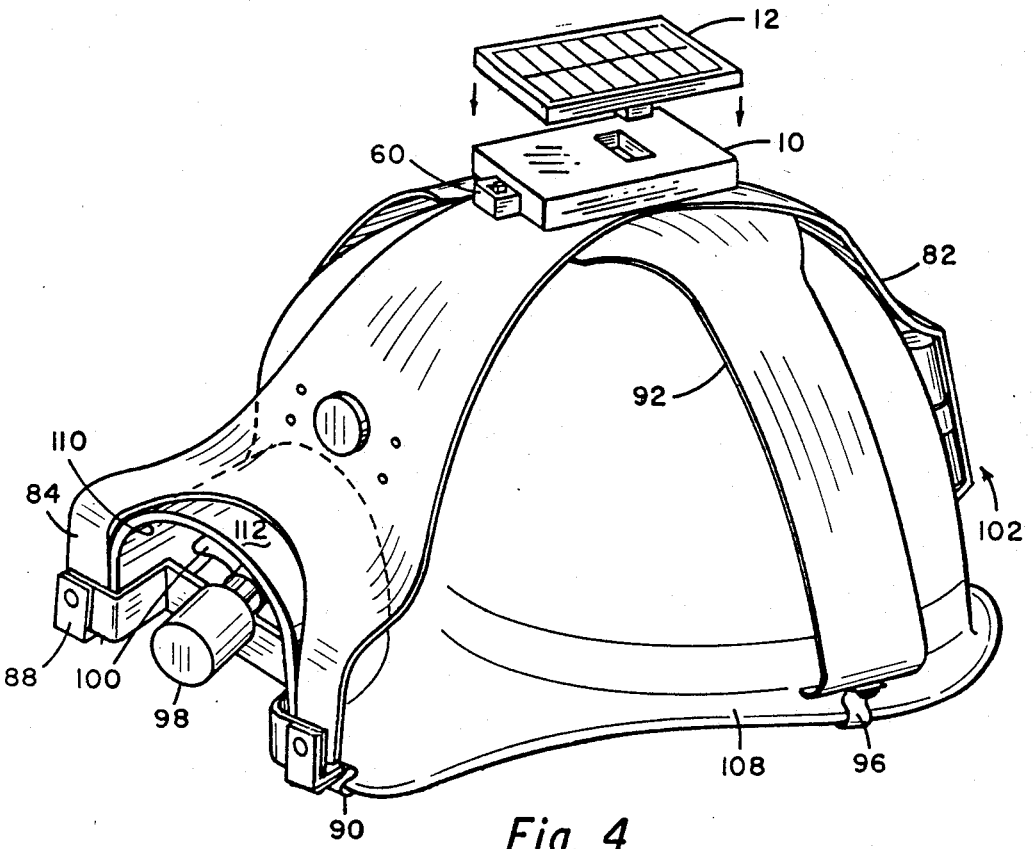
FIG. 4 is a perspective view of a hardhat with the strap of FIG. 3 attached thereto.
Figure 5:
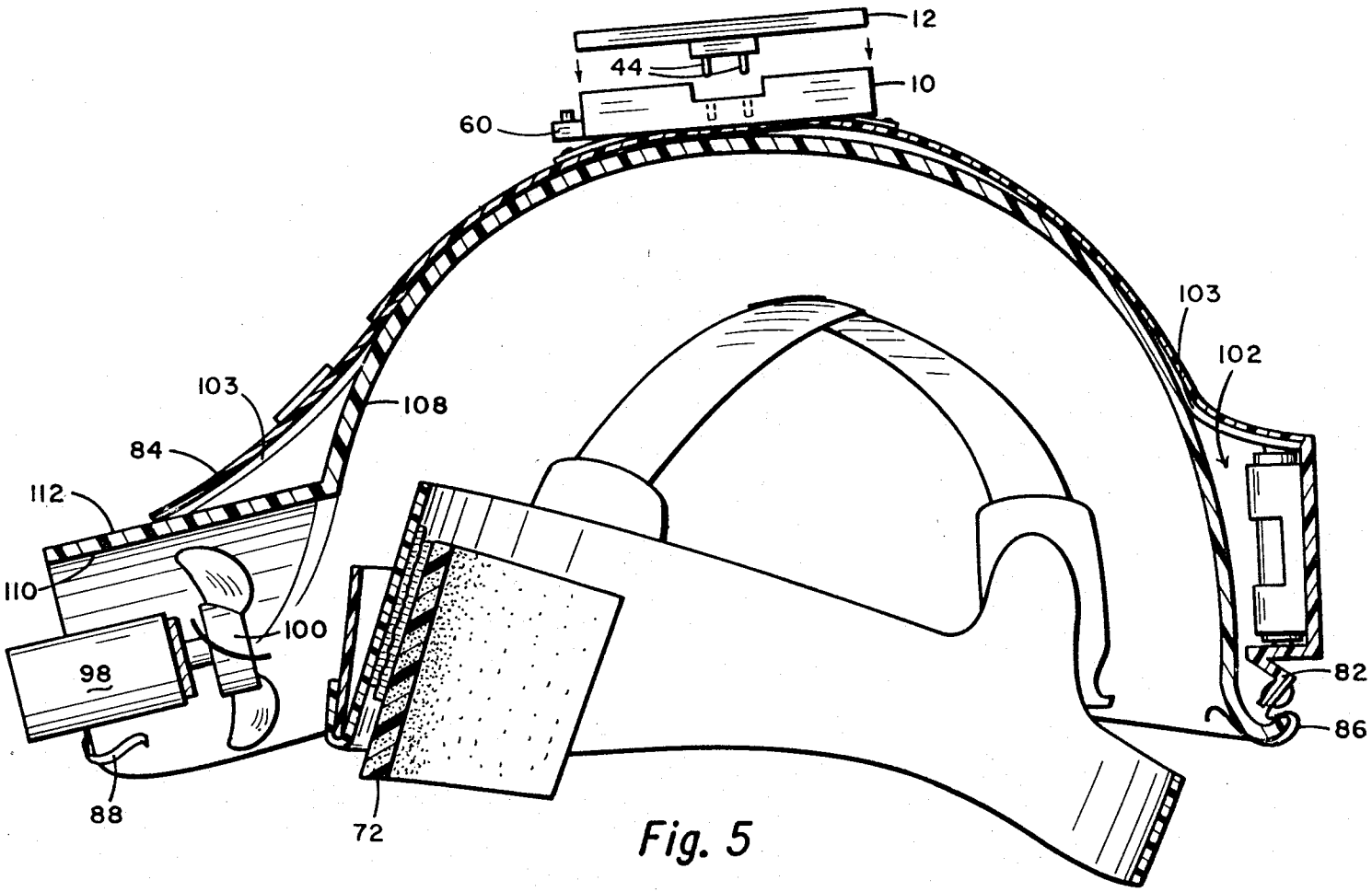
FIG. 5 is a sectional view of the hat of FIG. 4.

Referring now to FIGS. 3, 4 and 5, an all inclusive apparatus having battery and/or solar power and an electric motor driven fan for attachment to headwear is shown. In this instance, a strap means 80, having a rear portion 82 and a forward portion 84, includes headwear attachment means such as clips 86 for the rearward portion and 88 and 90 for the forward portion. A transverse strap 92 is adapted to be attached to strap 80 for side to side connection with the headwear utilizing any form of fastening means such as clips 94 and 96. Attached to the forward portion of the strap is an electric motor 98 which drives a fan 100. Attached to the rearward portion of strap 80 is an recessed area generally designated by the numeral 102 for a receiving batteries. Atop the unit is a power module 10 with switch (best shown in the other views) to removably receive a solar panel unit 12. Suitable wiring 103 to interconnect the power with the motor and module are beneath the straps, out of sight.

As shown in FIG. 4, the strap model with the self-contained electric motor driven air moving means and the electric power means, i.e., battery and solar module/panel concept, is shown attached to another form of plastic hardhat 108 which hat includes a forward opening 110 formed by the duct 112. Referring now to FIG. 5, the hat also includes a "Velcro" removably attached evaporative cooling pad 72 as described in FIG. 2.

Figure 6:
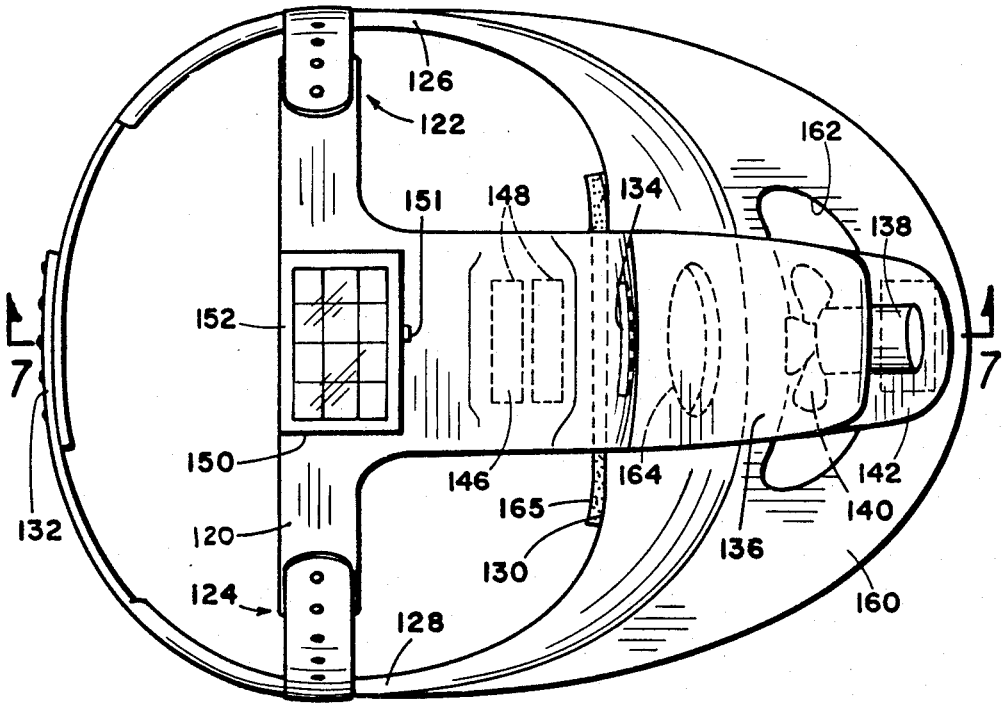
FIG. 6 is a top elevational view of an alternate embodiment view of the invention for use with a visor type of headwear.
Figure 7:
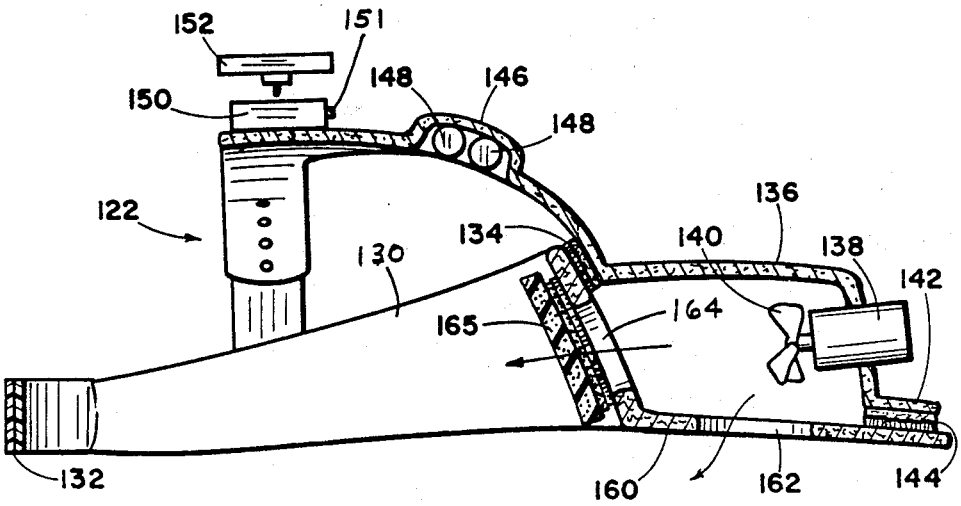
FIG. 7 is a sectional view taken along the line 7—7 of FIG. 6.

FIG. 6 and 7 describes an additional embodiment of the invention, as particularly adapted to a visor type of headwear. In this embodiment, a strap 120 is shown having first and second side means generally designated 122 and 124 for adjustable connection to the respective side portions 126 and 128 of the partial crown 130. Any form of adjustable means is adaptable to the invention, including the snap plug and hole type such as commonly found for size adjustment in most caps (shown herein as 132) or "Velcro," or snaps, or other forms of adjustable fastening means known in the art. The strap of the invention is adapted to be removably attached to the partial crown, as by "Velcro" connection 134 or by clips, snaps, etc. (not shown) for support of forward portion 136 to which is attached an electric motor 138 which drives fan 140. A lower portion 142 is supported and attached by "Velcro" means 144 or by clips, snaps, etc. (not shown) to the visor or 'bill' 160. The strap also includes a recess 146 along its length to receive batteries 148. Wiring 149 is recessed or hidden below the strap. The upper portion of the strap is a power module 150 with an on-off switch 151. The module is adaptable to receive a solar panel 152 therewith as has been previously described herein. The motor 138 and its driven fan 140 are adapted to be oriented on the visor portion 160 of the cap so as to direct air through openings 162 and 164 which have been formed in the visor and the partial crown portion respectively. Sponge pad 165 is releasably attached to the headband of the visor cap for evaporative cooling effect as described herein.

Figure 12:
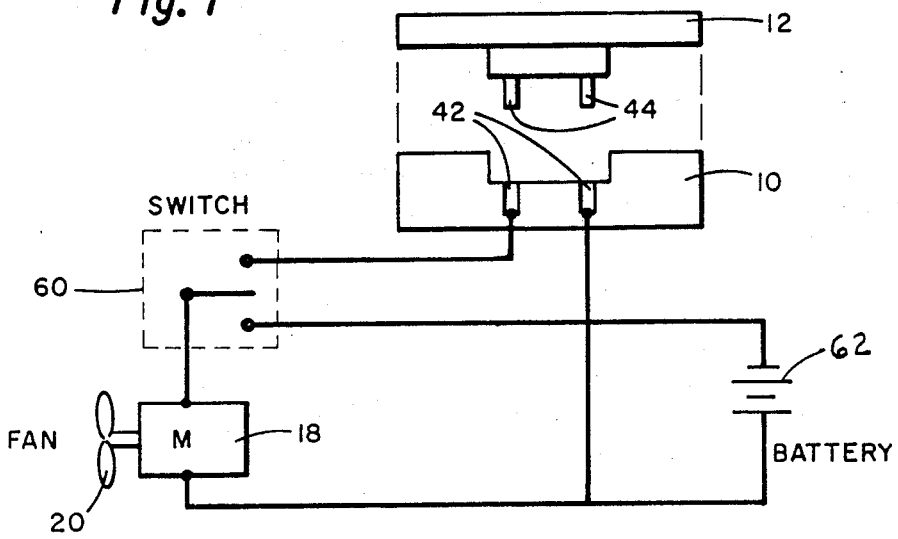
FIG. 12 is a schematic electrical wiring diagram of the apparatus used and described herein.
Figure 8:
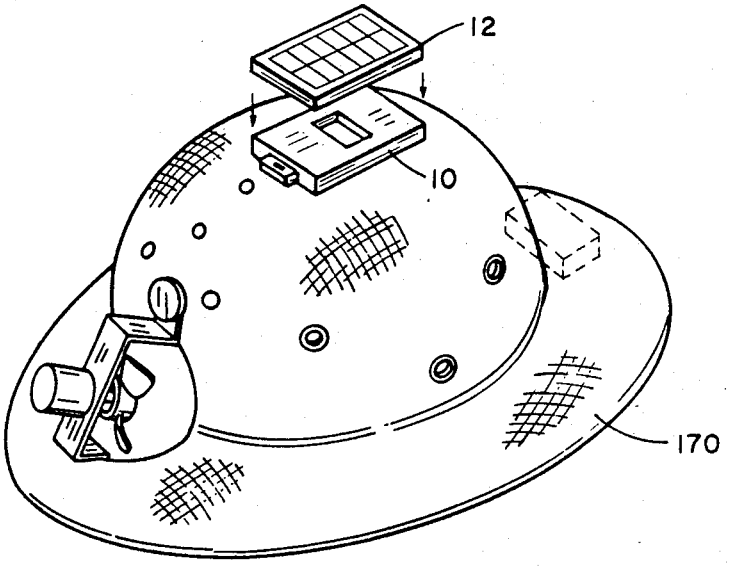
FIG. 8 is a perspective view of the embodiment of the invention for use with a helmet style of headwear.
Figure 11:
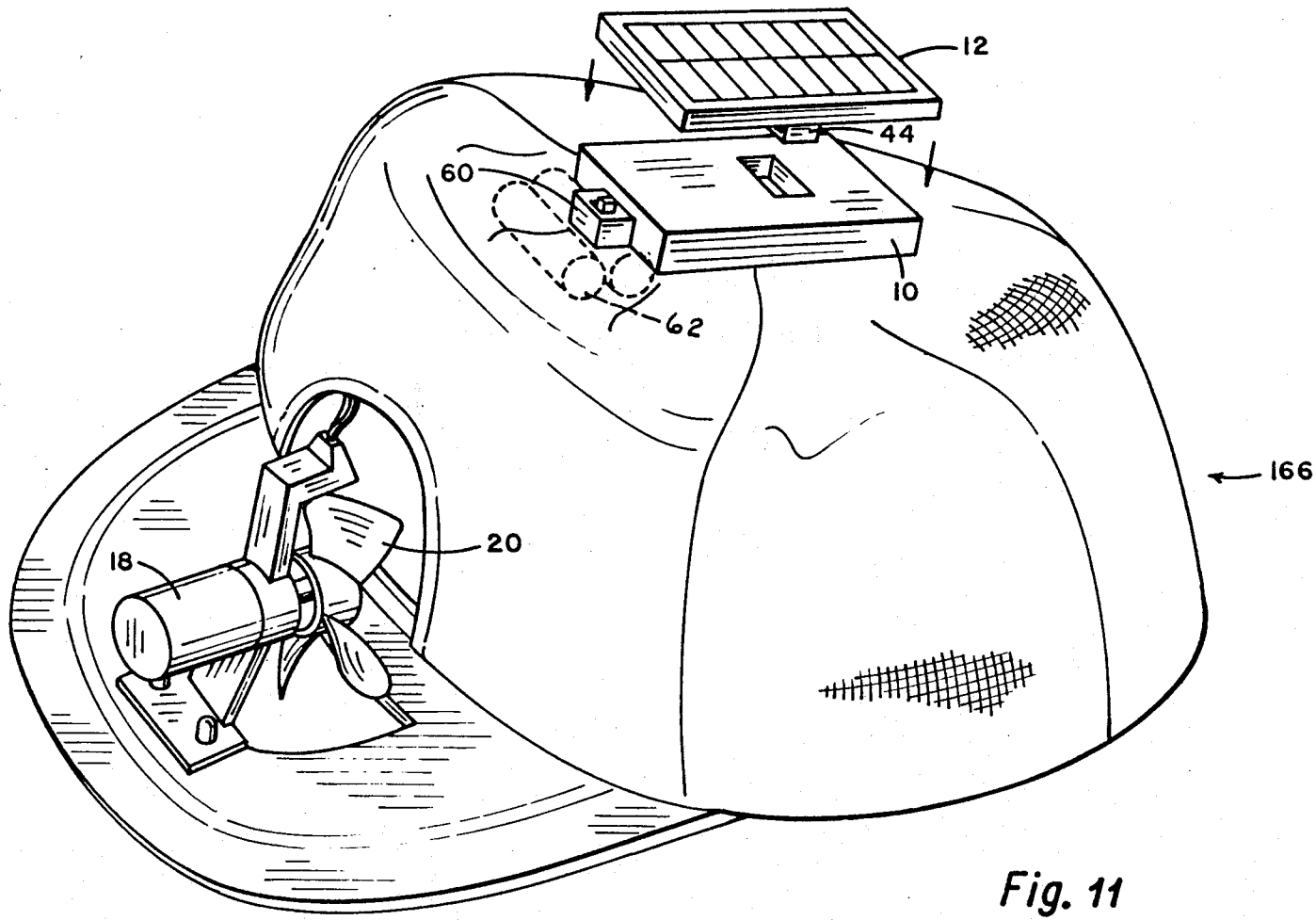
FIG. 11 is a perspective view of the invention incorporated herein as adapted to a baseball cap style headwear.

The view in FIG. 8 is merely an adaptation of the invention as it would be applied to a pith, "jungle" or safari helmet 170 with the adaption of the power module and solar panel concept herein described. Similarly, shown is the invention adapted to a baseball cap 166 of FIG. 11. FIG. 12 is an electrical wiring diagram to depict the wiring for the apparatus for this invention and should describe the switchability of the invention to either solar power or battery power or off.

Figure 13:
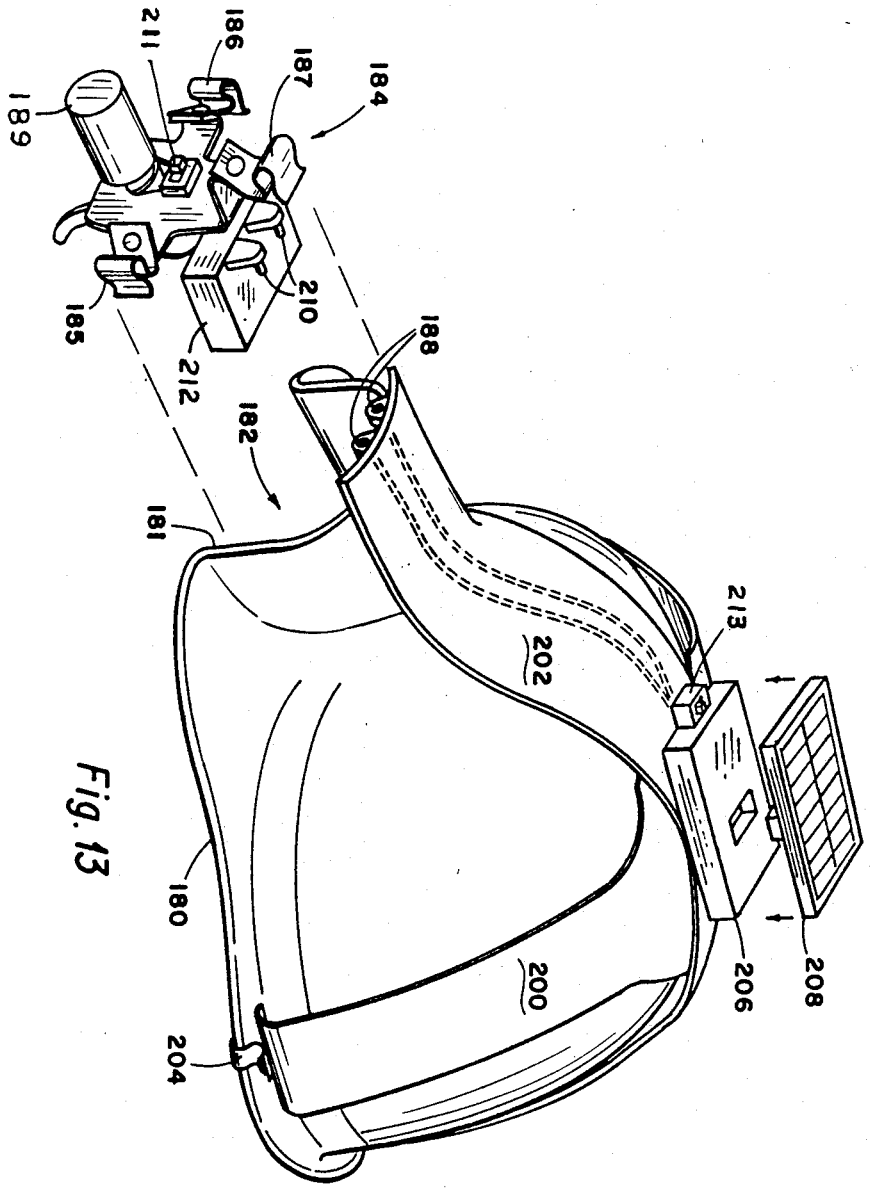
FIG. 13 is a perspective view, partly exploded, of another embodiment of the invention.

FIG. 13 represents another embodiment in connection with hard hat 180 having duct 181 defining opening 182 to receive a self-contained motor-fan-switch-battery package or unit generally designated as 184, which is releasably attached to the duct 181 as by clips 185, 186, and 187. Transverse strap means 200 and 202 have means, such as clips 204, to retain the strap to the hat. The strap also includes the heretofore described power module 206 with switch 213, removable solar panel 208 and suitable wiring, not shown, which ultimately connects with electrical sockets 188 for connection with electrical connection plugs 210 of the unit 184. In operation, when solar power is unavailable, switch 211 of the unit 184 operates the fan motor from the battery pack 212. If solar power is available, strap 200–202 is attached to the helmet 180, and solar cell 208 plugged in. Connection is made by inserting plugs 210 into sockets 188. With switch 211 'off' and switch 213 'on' solar power will operate the fan motor 189. Conversly with switch 211 'on' and switch 213 'off' battery power will operate the fan motor 189.

Figure 14:
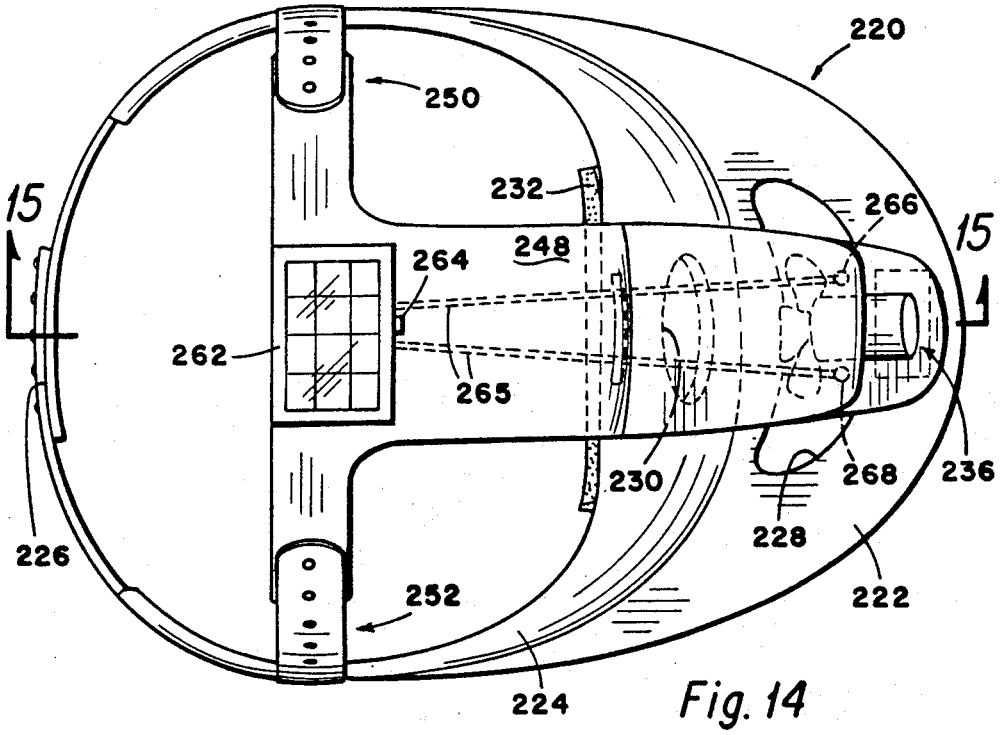
FIG. 14 is a top elevational view of an alternate embodiment.
Figure 15:
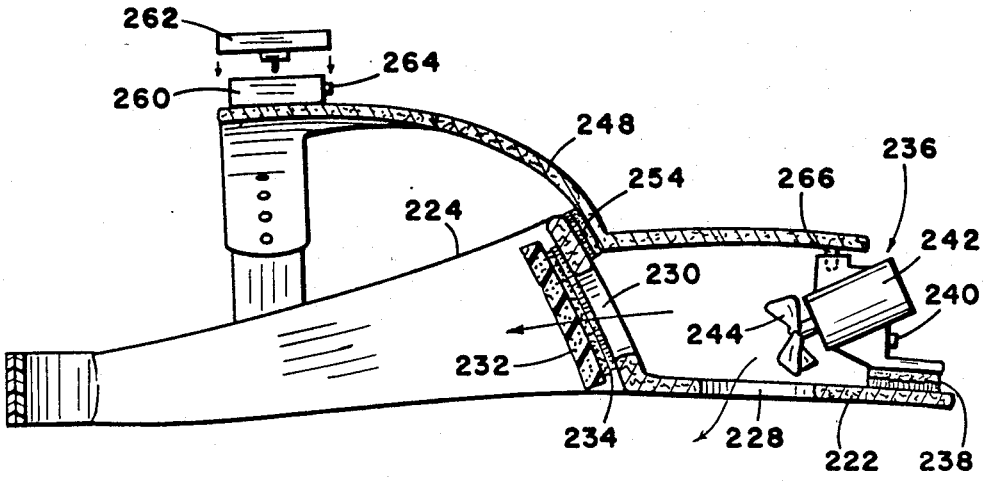
FIG. 15 is a cross-sectional view taken along the line 15—15 of FIG. 14.

FIGS. 14 and 15 represent another embodiment showing the broad concept of the invention as used on a visor style cap generally designated by the numeral 220. It is to be understood, however, that the concepts shown in these FIGS. (including FIG. 13) are adaptable to other styles of full crown caps, hats and helmets. The cap 220 includes a visor portion 222 and a partial crown 224 terminated at the rear by a head size adjustment means 226. Suitable openings 228 and/or 230 may be formed in the visor 222 and/or partial crown 224 for the flow of cooling air upon or around the head of the wearer. As previously described a moistenable sponge pad 232 can be removably fastened, as by "Velcro" 234, to the inner head band of the cap to provide evaporative cooling effect. A self contained unit having a battery operated electric motor driven air moving means, and generally designated as 236, is removably attached to the visor 222 to be self supporting as by snaps of Velcro 238 or other means, not shown, that are available to a man skilled in the art. By "self-contained" it is meant the assembled combination of battery power pack (not shown), a switch 240, a motor 242 and fan 244. The motor and fan are angularly oriented in the embodiment shown to flow cooling air through openings 228 and 230. In this embodiment solar power is connectable to the self contained unit by means of a removable strap 248, connectable as previously described in FIG. 6 to the sides of the partial crown at 250 and 252. The forward portion of the strap 248 includes removable support connection 254 ("Velcro") to the front partial crown as shown. A power module 260 is adaptable to removably receive, as previously described herein, solar panel 262. Electricity from the panel 262 is controlled by the module switch 264. Electrical wiring 265, which may be recessed in strap 248, extends from the module 260 to forward plug connectors 266 and 268, which snap into matching receptacle in the self contained unit 236.

The apparatus described in FIGS. 13, 14 and 15 permits use of the self contained battery operated units 184 and 236 with or without the straps 202 and 248 with their solar powered module and panels. That is, the self contained units are switchable to "on" or "off" from the battery power. If solar power is available, the strap 202 or 248 is attached to the cap, hat or helmet and plug-in, the self contained unit is switched off, the solar cell attached to the module, and switched "on", solar power is then applied to the motor fan to provide air movement on, against or around the head of the wearer. Once solar power is not available, the wearer can switch to battery power.

What is claimed is:

1. Headwear of the type covering at least a portion of a wearer's head and, having means to circulate air upon another portion of said wearer's head said means comprising an opening through said covering of said headwear.

an electric motor driven air moving means positioned contiguously of said at least one opening, a first self-contained power means attached to said headwear and connected to said electric motor, a power module attached to said headwear, said module having means to removably receive an alternate ›self-contained power source, switch means to selectively connect or disconnect said first power means or said alternate power source with said electric motor.

2. The headwear of claim 1 wherein said first power means is battery.

3. The headwear of claim 1 wherein said alternate power source is a solar panel.

4. The headwear of claim 1 wherein said first power means is a battery and said alternate power source is a solar panel.

5. The headwear of claim 1 wherein said headwear includes a headband to support said headwear upon the wearer's head, said headband including a removable moistenable pad between said headband and the wearer's head.

6. The headwear of claim 1 being a safety hardhat style

7. The headwear of claim 1 being a visor style

8. The headwear of claim 1 being a helmet hat style

9. The headwear of claim 1 being a baseball cap style.

10. Apparatus for attachment to the outer surface of headwear without altering said headwear comprising strap means having means to releasably attach said strap means to said headwear; said strap means having an electric motor driven air moving means situate thereon which when attached to said headwear will move or draw air upon or around the head of a wearer; a self-contained power source means attached to said strap means which power source means is selectively and electrically connectible to said electric motor.

11. The headwear of claim 10 wherein said headwear includes a headband to support said headwear upon the wearer's head, said headband including a removable moistenable pad between said headband and the wearer's head.

12. The headwear of claim 10 being a safety hardhat style.

13. The headwear of claim 10 being a visor style.

14. The headwear of claim 10 being a helmet hat style.

15. The headwear of claim 10 being a baseball cap style.

16. Headwear of the type covering at least a portion of a wearer's head, having means to circulate air upon another portion of the head of said wearer, said means comprising an opening through said covering of said headwear an integral unit having an electric motor driven air moving means, and a first self-contained power means for said motor, said unit being releasably attachable contiguously of said opening, said unit including electrical connection means to connect with a switchable alternate self-contained power source, strap means having means to releasably attach said strap means to said headwear, said alternate self-contained power source means attached to said strap means, said strap means further including electrical connector means to releasably attach to said electrical connection means, to selectively and electrically connect said first self-contained or alternate self-contained power source with said electric motor.

17. Apparatus of claim 21 wherein said strap means comprises a plurality of intersecting flexible straps.

18. Apparatus of claim 21 wherein said power source means comprises a battery.

19. Apparatus of claim 21 wherein said power source means comprises a battery and at least one solar cell.

20. Apparatus of claim 24 including a power module attached to said strap means, said module having means to removably receive said solar cell, and said module having a switch means to selectively connect and disconnect said battery power means on said solar cell with said electric motor.

21. The headwear of claim 21 wherein said headwear includes a headband to support said headwear upon the wearer's head, said headband including a removable moistenable pad between said headband and the wearer's head.

22. Apparatus of claim 21 wherein said means to releasably attach said strap to said headwear includes "Velcro" fasteners.

23. Apparatus of claim 21 wherein said means to releasably attach said strap to said headwear includes snap fasteners.

24. Apparatus of claim 21 wherein said means to releasably attach said strap to said headwear includes clips.

25. The headwear of claim 21 being a safety hardhat style

26. The headwear of claim 21 being a visor style

27. The headwear of claim 21 being a helmet hat style

28. The headwear of claim 21 being a baseball cap style.

29. The headwear of claim 16 wherein said integral unit includes a first switch to connect/disconnect said first self-contained power means with said electric motor, and wherein a second switch on said strap means to connect/disconnect said alternate self-contained power source with said electric motor, whereby said motor is alternatively powered from said first self-contained power means or said alternate self-contained power means, or disconnected from either power means.

30. Apparatus of claim 20 wherein said integral unit includes a switch to connect/disconnect said first power means with said electric motor.

31. Headwear of the type covering at least a portion of a wearer's head, having means to circulate air upon another portion of said wearer's head, said means comprising an opening through said covering of said headwear, an integral unit having an electric motor driven air moving means, and a first self-contained power means for said motor, said unit being releasably attachable to said headwear contiguously of said at least one opening, and said unit having a first switch to connect/disconnect said first self-contained power means, a power module attached to said headwear, said module having means to removably receive an alternate self-contained power source, said module having a second switch means to selectively connect/disconnect said alternate self-contained power source with said electric motor.

32. The headwear of claim 31 wherein said first power means is battery.

33. The headwear of claim 31 wherein said alternate power source is a solar panel.

34. The headwear of claim 31 wherein said first power means is a battery and said alternate power source is a solar panel.

35. Apparatus for attachment to headwear comprising a plurality of intersecting flexible straps having means to releasably attach said straps to the exterior of said headwear; said straps having an electric motor driven air moving means situate thereon which when attached to said headwear will move or draw air upon or around the head of a wearer; a self-contained power source means attached to said strap means which power source means is selectively and electrically connectible to said electric motor.

36. Apparatus of claim 35 wherein said headwear is modified to receive said electric motor driven air moving means.

37. Apparatus of claim 35 wherein said power source means comprises a battery.

38. Apparatus of claim 35 wherein said power source means comprises a battery and at least one solar cell.

39. The headwear of claim 35 wherein said headwear includes a headband to support said headwear upon the wearer's head, said headband including a removable moistenable pad between said headband and the wearer's head.

40. The headwear of claim 35 being a safety hardhat style.

41. The headwear of claim 35 being a visor style.

42. The headwear of claim 35 being a helmet hat style.

43. The headwear of claim 35 being a baseball cap style.

44. Apparatus for attachment to headwear modified to receive an electric motor driven air moving means comprising strap means having means to releasably attach said strap means to the exterior of said headwear; said strap means having said electric motor driven air moving means situate thereon which when attached to said modified headwear will move or draw air upon or around the head of a wearer; a self-contained power source means attached to said strap means which power source means is selectively and electrically connectible to said electric motor.

45. Apparatus for attachment to headwear comprising strap means having means to releasably attach said strap means to the exterior of said headwear; said strap means having an electric motor driving air moving means situate thereon which when attached to said headwear will move or draw air upon or around the head of a wearer; a self-contained battery type power source means attached to said strap means which battery type power source means is selectively and electrically connectible to said electric motor.

46. Apparatus for attachment to the outer surface of headwear comprising strap means having means to releasably attach said strap means to the exterior of said headwear; said strap means having an electric motor driven air moving means situate thereon which when attached to said headwear will move or draw air upon or around the head of a wearer; a self-contained battery and solar cell type power source means which battery and solar cell type power source means is selectively and electrically connectible to said electric motor.

47. Apparatus for attachment to headwear comprising a plurality of intersecting flexible straps having means to releasably attach said straps to said headwear; said straps having an electric motor driven air moving means situate thereon which when attached to said headwear will move or draw air upon or around the head of a wearer; a self-contained power source means attached to said strap means which power source means is selectively and electrically connectible to said electric motor, said power source means comprises a battery and at least one solar cell; a power module attached to said strap, said module having means to removably receive said solar cell, and said module having a switch means to selectively connect and disconnect said battery power means or said solar cell with said electric motor.

48. Apparatus for attachment to the outer surface of , headwear comprising strap means having means to releasably attach said strap means to said headwear; said strap means having an electric motor driven air moving means situate thereon which when attached to said headwear will move or draw air upon or around the head of a wearer; a self-contained battery and solar cell type power source means which battery and/or solar type power source means is selectively and electrically connectible to said electric motor; and a power module attached to said strap means, said module having means to removably receive said solar cell and said module having a switch means to selectively connect and disconnect said battery power means on said solar cell with said electric motor.

* * * * *

UNITED STATES PATENT AND TRADEMARK OFFICE

CERTIFICATE OF CORRECTION

PATENT NO. : 4,893,356

DATED : January 16, 1990

INVENTOR(S) : WILLIAM A. WATERS

It is certified that error appears in the above—identified patent and that said Letters Patent is hereby corrected as shown below:

Column 7, lines 1, 3, 5, 13, 18, 21, 24, 27, 29, 30, and 31, change "21" to --16--.

Column 7, line 7, change "24" to --19--

Signed and Sealed this

Twelfth Day of February, 1991

*Attest:*

HARRY F. MANBECK, JR.

*Attesting Officer*

*Commissioner of Patents and Trademarks*